United States Patent [19]

Bergeron

[11] Patent Number: 4,801,140

[45] Date of Patent: Jan. 31, 1989

[54] THERAPEUTIC EXERCISE EQUIPMENT FOR THE HANDICAPPED

[76] Inventor: Timothy J. Bergeron, R.D. 1 Box 40, Dolgeville, N.Y. 13329

[21] Appl. No.: 23,841

[22] Filed: Mar. 9, 1987

[51] Int. Cl.[4] ..... A63B 23/04; A63G 1/12

[52] U.S. Cl. ..... 272/146; 272/33 R; 280/87.01

[58] Field of Search ..... 272/33 R, 33 A, 56, 272/114, 146; 297/5, 6, 461, 462, 118, 119; 280/87.1, 30, 47.12, 87.01

[56] References Cited

U.S. PATENT DOCUMENTS

| | | | |
|---|---|---|---|
| 516,368 | 3/1894 | Davis | 272/56 |
| 1,345,322 | 6/1920 | Foans | 280/30 |
| 3,138,375 | 6/1964 | Smith | 272/114 |
| 3,220,744 | 11/1965 | Gomory et al. | 272/87.01 |
| 3,262,701 | 7/1966 | Howland | 272/146 |
| 3,279,794 | 10/1966 | Jenkins | 272/56 |
| 3,586,321 | 6/1971 | Gehrke | 272/146 |
| 3,612,520 | 10/1971 | Chang | 272/146 |
| 3,695,742 | 10/1972 | Allen | 297/462 X |
| 4,289,306 | 9/1981 | Thomas | 272/146 |
| 4,613,131 | 9/1986 | Anderson | 272/146 |

FOREIGN PATENT DOCUMENTS

| | | | |
|---|---|---|---|
| 3150189 | 7/1983 | Fed. Rep. of Germany | 272/146 |

OTHER PUBLICATIONS

Pages 10 and 11, Southpaw Enterprises, Inc., "Professional Quality Equipment for Sensory Integration and Developmental Programs", catalog, 1986 edition.

Page 33, Bailey Manufacturing Company product catalog.

*Primary Examiner*—Richard J. Apley
*Assistant Examiner*—J. Welsh
*Attorney, Agent, or Firm*—Heslin & Rothenberg

[57] ABSTRACT

Therapeutic exercise apparatus capable of being used by a physical therapist to initiate a number of different postural and equilibrium reactions in the body of a handicapped child with the goal of enhancing the child's ability to maintain balance and proper posture is disclosed. The apparatus consists of a hemisphere having a substantially rigid interior shell surrounded by a molded foam exterior. One end of the hemisphere is substantially flat and the other end is rounded. A removable cover located at the substantially flat end allows access to a hollow internal chamber within the hemisphere. One side of the removable cover is substantially flat and the other side has wheels secured thereto such that the cover may be separately used as a scooter. The cover is selectively attachable to the hemisphere on either side, the opposite side forming a portion of the substantially flat end such that the hemisphere may include wheels at its substantially flat end. A leg is also provided capable of detachable engagement with the cover so as to form a T-stand.

33 Claims, 5 Drawing Sheets

THERAPEUTIC EXERCISE EQUIPMENT FOR THE HANDICAPPED

BACKGROUND OF THE INVENTION

This invention relates generally to exercise equipment for those who are handicapped and more particularly, to therapeutic exercise equipment useful in enhancing a handicapped child's ability to maintain balance and proper posture.

The ability to maintain balance is fundamental to more advanced perceptual motor activities. Balance mechanisms, along with vision, tactile information and proprioceptor feedback, provide the knowledge for perceiving body orientation in space. Balance, defined as the ability to maintain equilibrium while engaging in various locomotor or non-locomotor activities, may be partially or totally deficient in some children. In particular, neurologically impaired children, such as those suffering from cerebral palsy or muscular dystrophy, often lack those postural adjustments and equilibrium reactions which comprise the basic movement patterns necessary for balance and proper posture.

An individual's equilibrium is used to regain shifted. Equilibrium reactions may be simple postural adjustments or more obvious protective reactions, for example, to stop a fall. In either case, these reactions are typically automatic or semi-automatic, working best when we do not need to think about them. Where these reactions are deficient, they must be taught or developed through appropriate physical therapy. Rhythmic movements involving the entire body assist best in developing these reactions or basic controls.

Today various types of therapeutic exercise equipment or apparatus are available to assist a therapist in initiating controlled postural and equilibrium reactions in the body of a handicapped child. Unfortunately, most, if not all, existing apparatus is designed to initiate only a specific type of movement, e.g., a rocking, rotating or swinging movement. As a result, a therapist must typically own a number of different types of exercise equipment to be able to provide a child with a full range of physical therapy. This is especially problematic today since the enactment of the Education for all Handicapped Children Act of 1975, Public Law No. 94–142, which requires that all children have an equal right to an education, including an equal right to physical therapy when needed. Thus, today a physical therapist is often required to travel from school to school to meet with a multitude of children, and in the process typically must transport a variety of needed exercise apparatus with him.

Thus, a need exists today for compact therapeutic exercise equipment capable of being used to initiate a wide range of different postural and equilibrium reactions in the body of a handicapped child, both of a higher and lower level of difficulty.

SUMMARY OF THE INVENTION

Accordingly, a principal object of the present invention is to provide therapeutic exercise equipment capable of being used to initiate a number of different postural and equilibrium reactions in the body of a handicapped child with the goal of enhancing the child's ability to maintain balance and proper posture.

Another object of the present invention is to provide therapeutic exercise equipment capable of being used to develop in a child either higher level or lower level balance skills, or both.

Yet another object of the present invention is to provide such therapeutic exercise equipment which is compact, lightweight and easy to transport.

The present invention accomplishes these objects by providing exercise equipment or apparatus capable of being used by a physical therapist to initiate a number of different postural and equilibrium reactions in the body of a handicapped child. In its most basic aspect, the exercise apparatus includes a hemisphere having a substantially rigid interior shell surrounded by a molded foam exterior. One end of the hemisphere is rounded and the other end is substantially flat such that a number of different therapeutic exercises may be conducted with either the rounded end or the substantially flat end contacting the floor and the child positioned on the opposite or upward facing end.

In another aspect, the exercise apparatus of the present invention includes a cover detachably secured to the hemisphere at its substantially flat end to allow access to a hollow internal chamber defined within the hemisphere. The cover preferably has a first substantially flat side and a second side, opposite the first side, with coasters secured thereto such that when the cover is detached from the hemisphere it may be separately used as a scooter. In addition, securement means for attaching the cover to the hemisphere are provided such that either the first side or second side of the cover is able to form a portion of the hemisphere's substantially flat end. This allows the physical therapist to construct a wheeled hemisphere which provides for various additional postural and equilibrium reactions to be initiated. An adjustable leg capable of being connected to the cover is also preferably included with the exercise apparatus such that a height adjustable T-stand is formed when the cover is removed from the hemisphere and the leg is secured thereto.

In yet another aspect, the exercise apparatus consists of a scooter having a first, substantially flat side and a second side, opposite the first side, having wheels permanently attached thereto. An adjustable leg is provided capable of being detachably secured to the second side of the scooter such that when the leg is connected to the scooter an adjustable T-stand is formed. This apparatus is capable of being used by the therapist to initiate a number of controlled postural and equilibrium reactions in the body of a handicapped child, being usable either as a scooter or T-stand.

BRIEF DESCRIPTION OF THE DRAWINGS

While the specification concludes with claims particularly pointing out and distinctly claiming the present invention, the objects, features and advantages of the present invention can be more readily ascertained from the following detailed description of one preferred embodiment when read in conjunction with the accompanying drawings in which:

DETAILED DESCRIPTION OF THE INVENTION

Figure 1A:
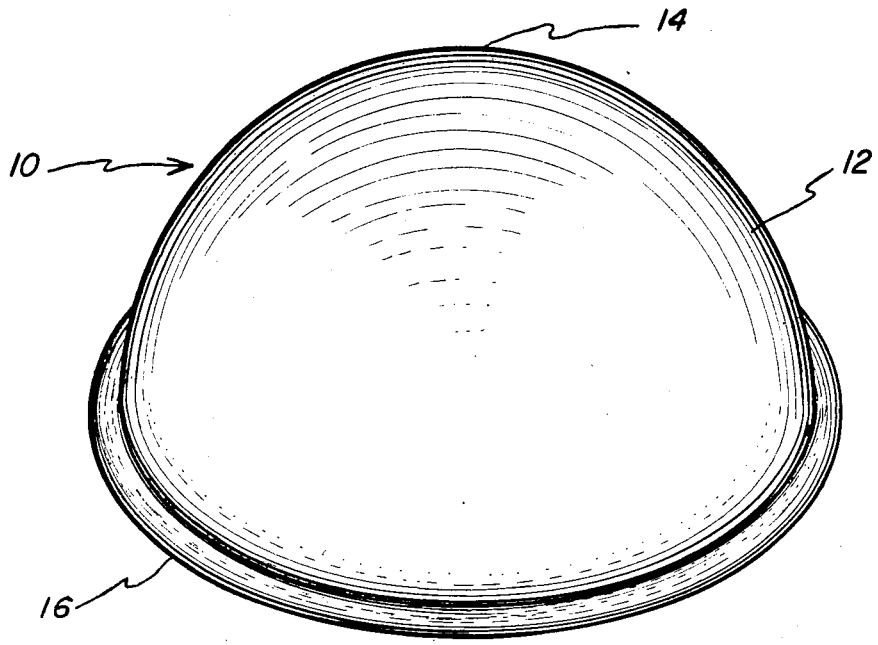
FIGS. 1A and 1B are perspective views of one preferred embodiment of the therapeutic exercise equipment of the present invention.
Figure 1B:
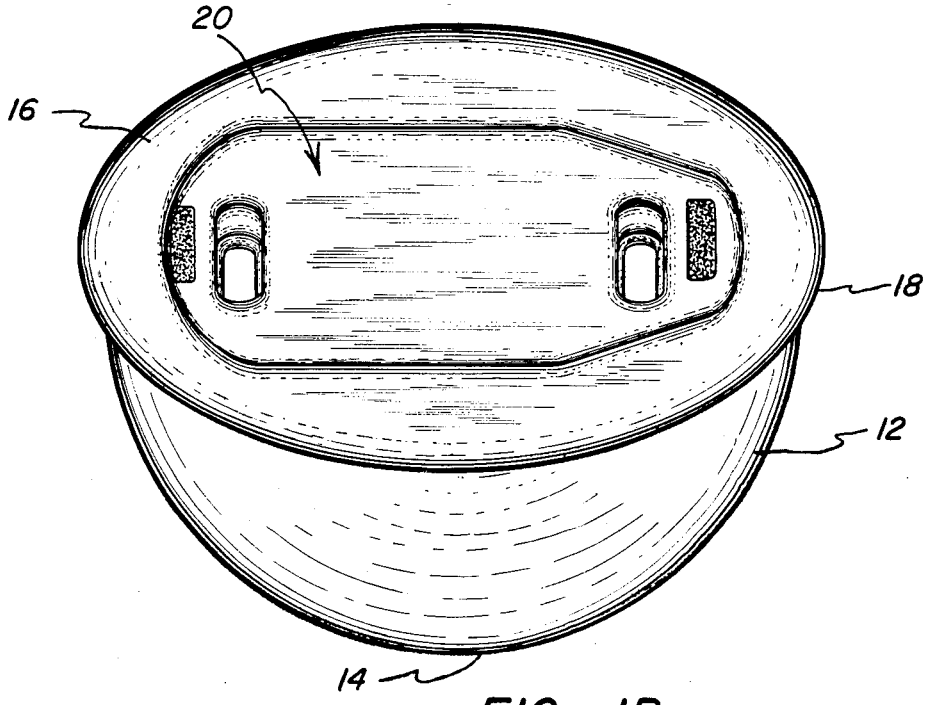

One preferred embodiment of the therapeutic exercise equipment or apparatus of the present invention, generally denoted as 10, is shown perspectively in FIGS. 1A and 1B. Apparatus 10 has a main body member or structure 12 which can be substantially hemispherical in shape as shown or of some other configuration, such as box, bullet, or bowl shaped, etc. (hereinafter referred to as "hemisphere 12"). One end 14 of hemisphere 12 is rounded and the other end 16 is substantially flat. Apparatus 10 is designed such that either end 14 or end 16 of hemisphere 12 may be contacting the floor when in use. A lip or rim 18 which is capable of functioning as a hand grip, is provided adjacent substantially flat end 16 to assist a child i maintaining balance when seated on end 16 as discussed below.

Figure 2:
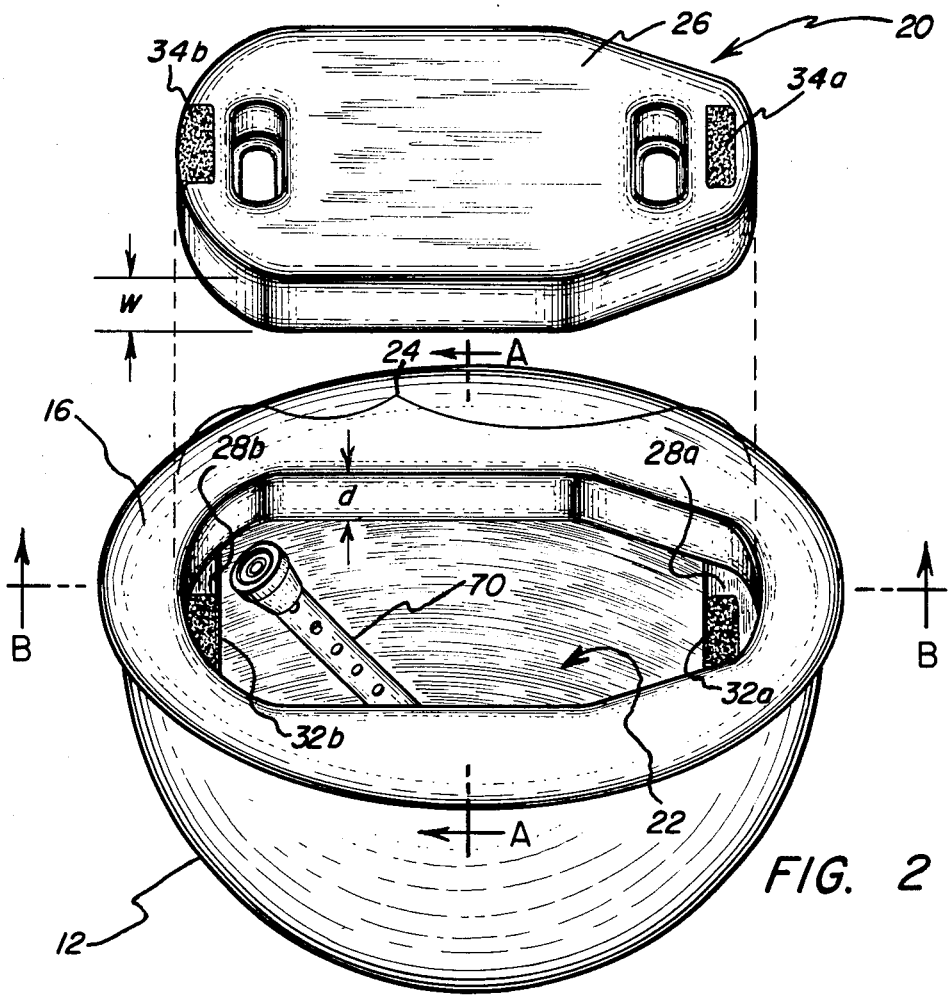
FIG. 2 is an exploded perspective view of the therapeutic exercise equipment as shown in FIG. 1B.

As shown in FIGS. 1B and 2, apparatus 10 also includes a detachable cover 20, which serves in part to allow access to a hollow internal chamber 22 in hemisphere 12. Internal chamber 22 provides a convenient storage space for miscellaneous exercise items and/or patient files. The shape and dimensions of cover 20 may vary but should be sufficient to support a child as discussed in detail below. Substantially flat end 16 has an open or recessed portion 24 appropriately configured to accommodate cover 20 therein. Recessed portion 24 has a depth "d" approximately equivalent to the width "w" of cover 20 such that a substantially flat side 26 of cover 20 is coplanar with end 16 when cover 20 is secured to hemisphere 12 and forms a portion of the hemisphere's substantially flat end. Also provided in hemisphere 12 are two ledges **28*a* and 28*b* which partially define recessed portion 24 and provide support for cover 20 when it is secured to hemisphere 12**.

Loop-type fabrics **30*a* and 30*b* (see FIG. 4) are attached to a second side 32 of cover 20, opposite substantially flat side 26, so as to detachably engage hook-type fabrics 32*a* and 32*b* secured to ledges 28*a* and 28*b*, respectively. As shown in FIG. 2, side 26 of cover 20 also preferably includes loop-type fabrics 34*a* and 34*b* which again are capable of selectively detachably engaging hook-type fabric 32*a* and 32*b*, respectively. Thus, either side 26 or 32 of cover 20 is positionable so as to form a portion of end 16 of hemisphere 12. This ability to select between which side of cover 20 is to form a portion of end 16 is important since side 32 preferably has a plurality of wheels or coasters 40*a*, 40*b*, 40*c* and 40*d* secured thereto, the uses for which are discussed below. A particularly efficient loop-type fabric 30*a*, 30*b*, 34*a* and 34*b* and hook-type fabric 32*a* and 32*b*** combination is commercially available under the trademark "Velcro".

Figure 3A:
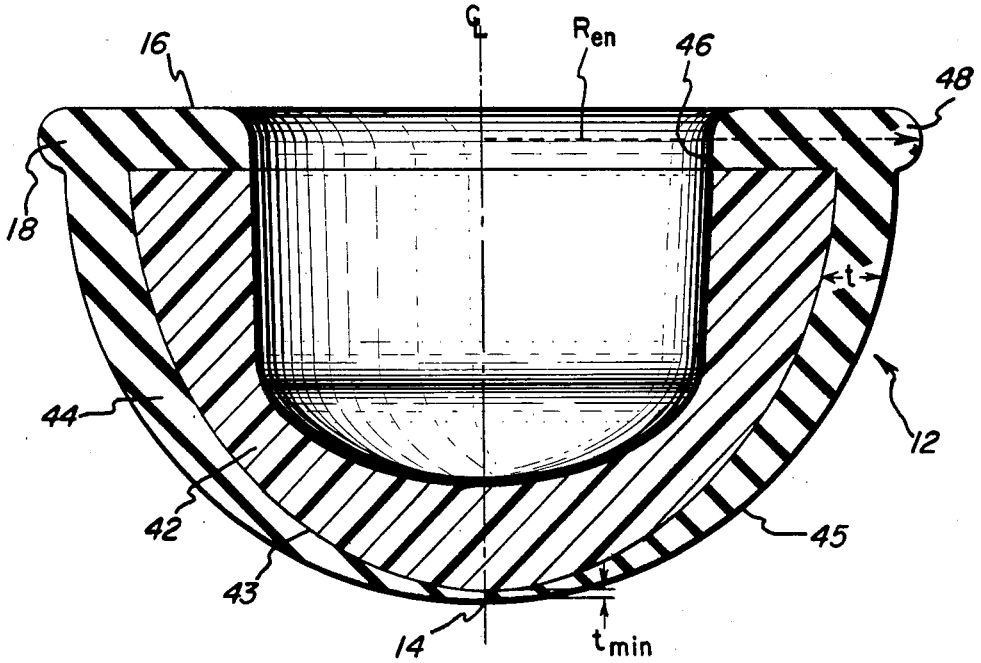
FIGS. 3A and 3B are cross-sectional views of the hemisphere shown in FIG. 2 taken along lines A—A and B—B, respectively.
Figure 3B:
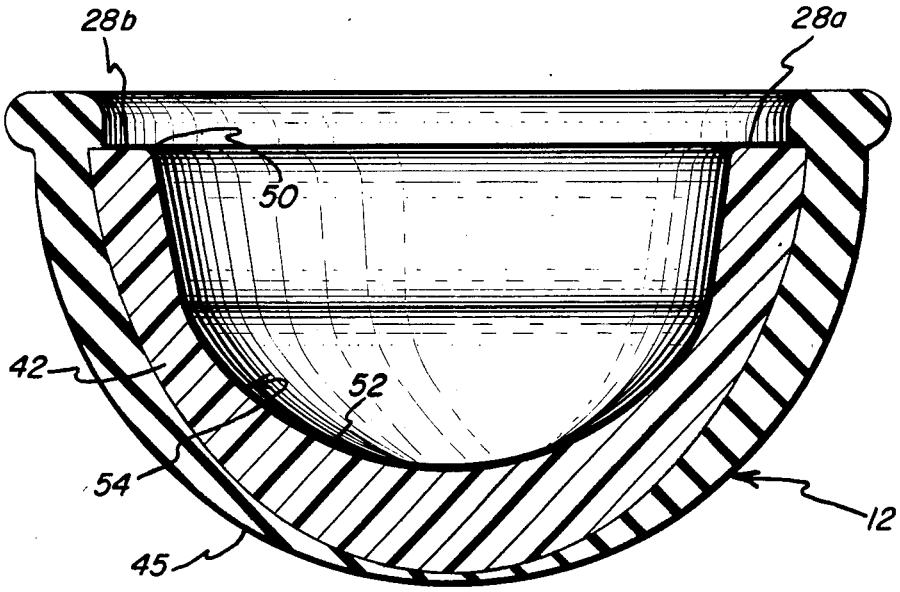

The construction of hemisphere 12 will be described with reference to FIGS. 3A and 3B, which are cross-sectional views taken along perpendicularly intersecting imaginary lines A—A and B—B, respectively, in FIG. 2. Hemisphere 12 has an essentially rigid internal shell or core 42 surrounded by a foam exterior 44. Exterior 44 consists of a resilient molded foam material which is coated with a durable, seamless exterior covering 45. The thickness "t" of foam exterior 44 is shown to increase along the side 43 of shell 42 from rounded end 14 to flat end 16. Rounded end 14 preferably has a foam exterior 44 of minimal thickness "$t_{min}$" so that when end 14 is contacting a floor the exterior foam does not result in undue damping of a particular balance exercise. A minimum thickness "$t_{min}$" is, however, preferred over no exterior foam for comfort reasons when apparatus 10 is used with substantially flat end 16 contacting the floor. Lip 18 is defined by a disc-shaped portion 46 of enlarged radius "$r_{en}$" from the center axis "$c_L$" of hemisphere 12. In the embodiment shown, the outer ring 48 of disc-shaped portion 46 is constructed only of molded foam material. This provides a surface which children find helpful and comfortable when apparatus 10 is used in a position with rounded end 14 contacting the floor and the child seated on flat end 16. Cover 20, which comprises the center of disc-shaped portion 46, is supported by ledges **28*a* and 28*b*. As shown in FIG. 3B, ledges 28*a* and 28*b* are defined by portions of edge 50 of rigid interior shell 42. Inner surface 54 of interior shell 42 is preferably coated with a durable seamless covering 52 the same as covering 45 over the outer surface of hemisphere 12**.

Figure 4:
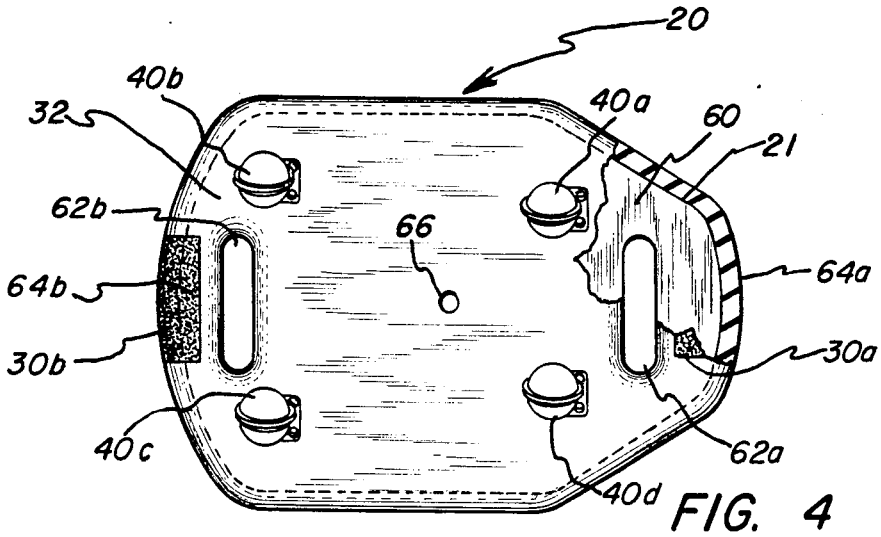
FIG. 4 is a bottom plan view of the cover shown in FIG. 2.

Referring to FIG. 4, it will be observed that cover 20 includes a substantially rigid internal plate 60 surrounded in part by a molded foam material and completely coated with a durable, seamless exterior covering as discussed above in connection with hemisphere 12. Molded foam material is secured below the seamless exterior covering to substantially flat side 26 for user comfort and peripheral edge 21 of internal plate 60 to act as a bumper when cover 20 is used in certain applications of apparatus 10 discussed below. As mentioned above, wheels or coasters **40*a*, 40*b*, 40*c* and 40*d* are secured to side 32 of cover 20 such that when cover 20 is removed from hemisphere 12, it may be separately used as a scooter. In addition, cover 20 preferably has two slots 62*a* and 62*b*, positioned near ends 64*a* and 64*b*, respectively, which function as handles for convenient carrying of cover 20 when removed from hemisphere 12 or for convenient carrying of apparatus 10 when secured to hemisphere 12. Slots 62*a* and 62*b* also provide a child with hand grips when cover 20 is used separately from hemisphere 12**.

Figure 5:
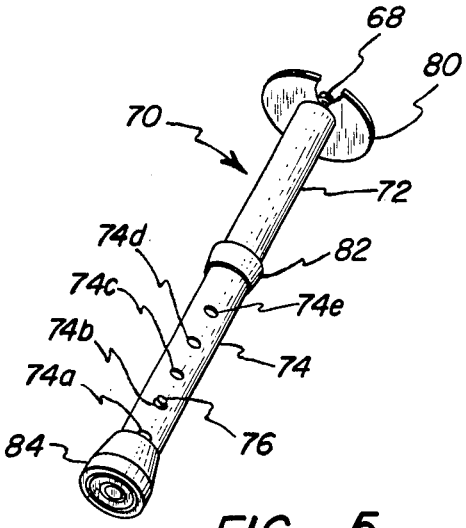
FIG. 5 is a perspective view of an adjustable leg capable of being connected to the cover shown in FIG. 4.

A threaded internal bore 66 is provided in side 32 near the center of cover 20 for accommodating and engaging a threaded stem 68 positioned at one end of an adjustable leg 70 shown in FIG. 5. When adjustable leg 70 is secured to cover 20 a T-stand or T-stool is constructed (see FIG. 6E). Leg 70 is preferably adjustable so that the height of the T-stand formed by the combination of the cover and leg may be changed to accommodate children of varying height. Leg 70 consists of two slideably engageable, concentric cylinders 72 and 74 which are adjustable relative to each other by any known means. For example, a spring-loaded peg 76 may be provided at one end of cylinder 72 to selectively engage one of a plurality of holes **78*a*, 78*b*, 78*c*, 78*d* provided in cylinder 74. A disc-shaped plate 80 is secured to cylinder 72 at that end having threaded peg 68 to provide a wide surface area of contact between adjustable leg 70 and cover 20 when threaded peg 68 is secured within threaded bore 66, thus lessening the chance that adjustable leg 70 could be broken away from cover 20. This object is best accomplished when plate 80 is substantially in contact with plate 60 of cover 20, which is why side 32 of cover 20 contains no molded foam material. A guide 82 is provided between cylinders 72 and 74 to maintain appropriate spacing and to allow for a close tolerancing of the cylinders. A floor bumper 84, e.g. made of a rubber material, is included at the free end of cylinder 74 to prevent damage to a floor whenever leg 70 and cover 20** are used as a T-stand.

Various different functional embodiments or applications of apparatus 10 of the present invention are illustrated in FIGS. 6A–6E. Apparatus 10 is first usable with cover 20 secured to hemisphere 12 and rounded end 14 contacting a floor (FIG. 6A), in which case the child sits tailor or Indian style on the upward facing, substantially flat end 16. In this position, a therapist provides movement of the apparatus through space by rocking right to left or forward and backwards, asking the child to maintain balance. The child may be partially supporting and balancing himself by grasping lip 18. The level of skill required by this exercise varies in relation with the degree of rocking initiated by the therapist. This exercise promotes equilibrium reactions and trunk strengthening.

Figure 6D:
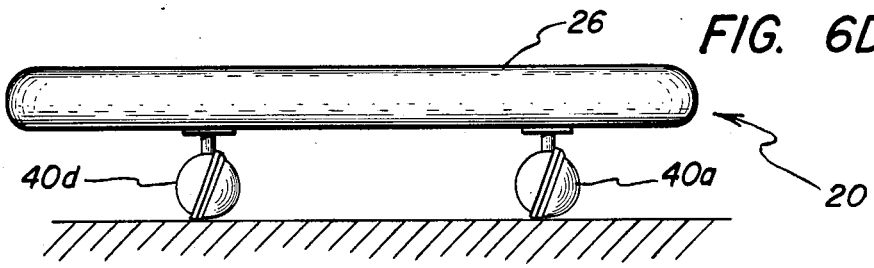
FIGS. 6A–6E are side elevational views of the different functional embodiments of the present invention, FIGS. 6D and 6E being magnified somewhat in relation to FIGS. 6A–6C.
Figure 6E:
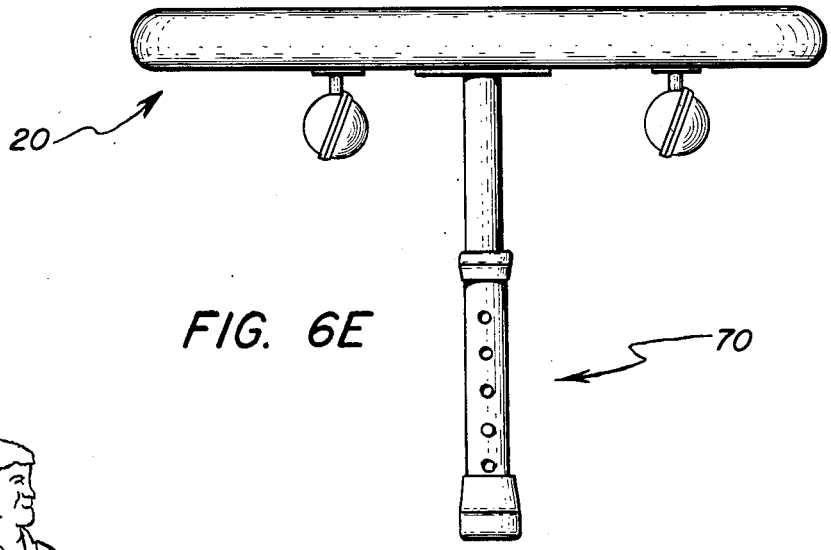
Figure 6A:
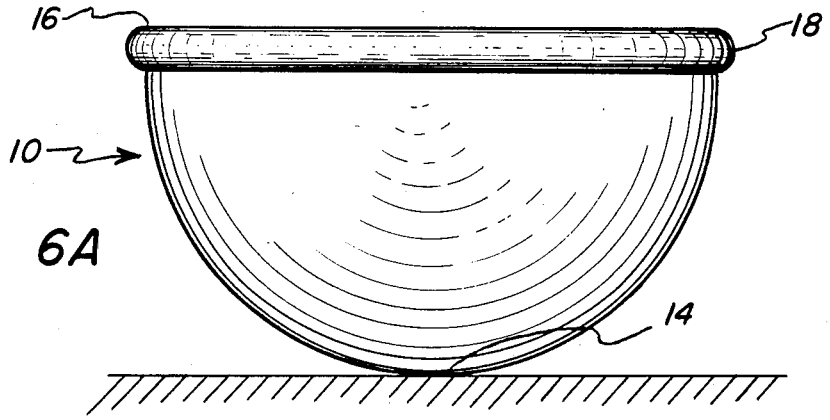
Figure 6B:
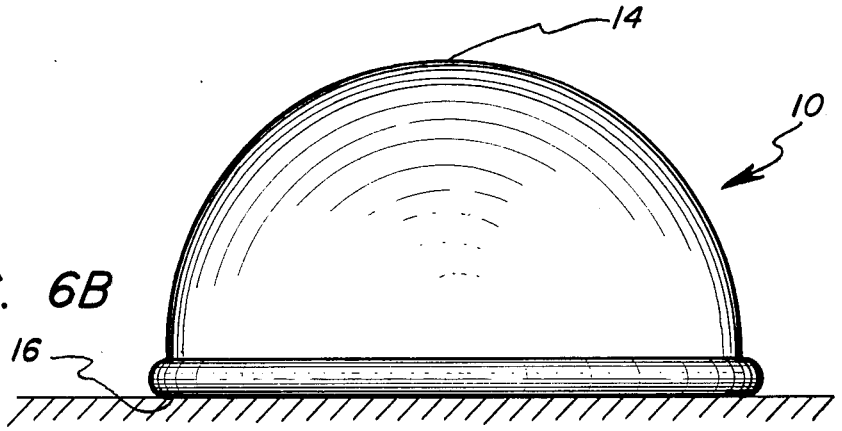

Apparatus 10 is alternately usable with substantially flat end 16 contacting a floor (FIG. 6B). In this position, a child sits on rounded end 14 with feet on the floor and attempts to maintain balance. This activity tests lower level balance skills. Target and throw/catch games can be played if desired. The exercise promotes equilibrium reactions, eye-hand coordination and proprioception to lower extremities.

Figure 6C:
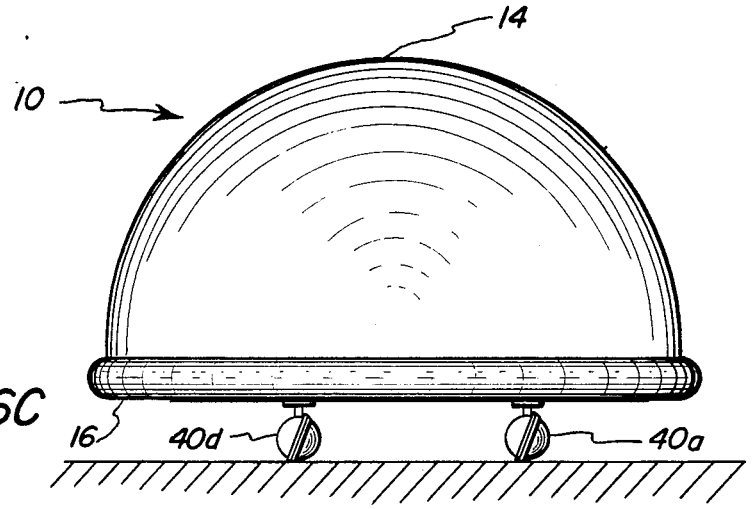

In addition, cover 20 is capable of being selectively secured to member 12 such that substantially flat end 16 includes wheels **40*a*, 40*b*, 40*c* and 40*d* which contact the floor when end 16 is facing downward (FIG. 6C). In this configuration, a child lies prone over rounded end 14** with his weight bearing on the upper extremities. Upper extremity weight shifting is facilitated by asking the child to toss bean bags at a target using one hand. The exercise promotes proprioception to upper extremities, reflex integration and eye-hand coordination.

When removed from body member 12, cover 20 is usable as a scooter with wheels **40*a*, 40*b*, 40*c* and 40*d* contacting the floor (FIG. 6D). In this configuration, a child sits on substantially flat side 26 of cover 20 and uses both feet to propel himself while holding on to cover 20 by using slots 62*a* and 62*b* as hand grips. This particular exercise promotes equilibrium reaction, proprioception to lower extremities and eye-foot coordination. An additional exercise which may be performed with cover 20 functioning as a scooter is to have the child lie prone on substantially flat surface 26** and use his arms to propel himself. Various tag and relay games can be played in this position. The exercise promotes prone extension posture, upper extremity proprioception, muscle cocontraction and bilateral motor coordination.

As noted above, by attaching adjustable leg 70 to cover 20 a T-stand is formed (FIG. 6E). A child may sit on the resulting T-stand with feet on the floor and attempt to maintain balance. Throw/catch games may also be performed in this position, resulting in higher level balance skills being tested. The exercise promotes equilibrium reactions, eye-hand coordination, lower extremity weight bearing for proprioception to hips, knees and ankles.

Figure 7:
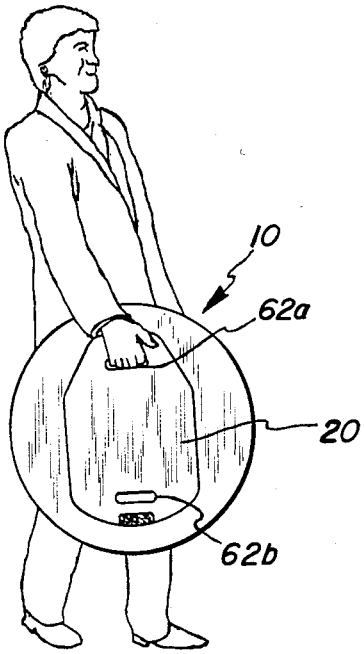
FIG. 7 is a perspective view of the therapeutic exercise equipment of the present invention positioned for transport with the cover and hemisphere shown in FIG. 2 secured together.

Apparatus 10 is constructed so as to be lightweight and compact with various miscellaneous items being storable within chamber 22 of hemisphere 12, e.g., adjustable leg 70 (see FIG. 2), a foam ball, and/or a net swing (i.e., a structure commonly used to initiate through swinging movements various different types of equilibrium reactions). As shown in FIG. 7, when apparatus 10 is positioned on its side an individual can easily grasp slot **62*a* or 62*b* in cover 20 and carry the entire structure. The fact that apparatus 10** is compact and easy to transport is particularly beneficial since as mentioned above therapists routinely travel between schools today and in the process have to carry with them any needed exercise equipment.

It will be noted from the above that this invention fully meets the objectives set forth. Therapeutic exercise apparatus is provided which is capable of being used to initiate a number of different postural and equilibrium reactions in the body of a handicapped child. In addition it will be observed that the number of different exercises available include exercises for developing both lower level and higher level balance skills. Further, it is apparent that the therapeutic exercise apparatus of the present invention is compact and easy to transport.

Although one embodiment has been illustrated in the accompanying drawings and described in the foregoing description, it will be understood that the invention is not limited to the particular embodiment discussed but is capable of numerous rearrangements, modifications and substitutions without departing from the scope of the invention. For example, the size and dimensions of the exercise apparatus may vary and its use is not limited solely to children but rather adults may benefit from certain exercises as well. The following claims are intended to encompass all such modifications.

I claim:

1. Therapeutic exercise apparatus capable of being used to initiate postural and equilibrium reactions in the body of handicapped individual with the goal of enhancing the individual's ability to maintain balance and proper posture, said therapeutic exercise apparatus comprising:

a hemisphere having an exterior manufactured of a soft foam material and having a substantially rigid internal shell, said hemisphere having two ends, one end of said hemisphere being rounded and the other end of said hemisphere being substantially flat, the width of said molded foam material increasing from a minimum at said rounded end to a maximum adjacent said substantially flat end, whereby various balance and postural exercises may be conducted with either one of said rounded end and said substantially flat end contacting the floor.

2. The therapeutic exercise apparatus of claim 1, wherein said rigid interior shell is parabolic-shaped.

3. The therapeutic exercise apparatus of claim 2, wherein said hemisphere includes a disk-shaped portion of increased radius located adjacent said substantially flat end.

4. The therapeutic exercise apparatus of claim 3, wherein the lip formed by said disk-shaped portion consists of said molded foam material.

5. The therapeutic exercise apparatus of claim 1, wherein said hemisphere has a hollow internal chamber, and further comprising a removable cover positioned on said hemisphere which allows access to said internal chamber, whereby said internal chamber may be used to store miscellaneous items.

6. The therapeutic exercise apparatus of claim 5, wherein said cover is non-circular in shape.

7. The therapeutic exercise apparatus of claim 6, wherein said cover is located at said substantially flat end of said hemisphere.

8. The therapeutic exercise apparatus of claim 7, wherein said cover has two sides, one side of said cover being coplanar with said substantially flat and when said cover is secured to said hemisphere such that said coplanar side of said cover forms a portion of said substantially flat end.

9. The therapeutic exercise apparatus of claim 8, wherein said cover has a substantially rigid interior plate covered on one side and its edge by a molded foam exterior, said side having said molded foam exterior being substantially flat.

10. The therapeutic exercise apparatus of claim 9, wherein wheels are secured to said interior plate on that side of said cover opposite said substantially flat side such that when said cover is removed form said hemisphere it is useable as a scooter.

11. Therapeutic exercise apparatus capable of being used to initiate postural and equilibrium reactions in the body of a handicapped individual with a goal of enhancing the individual's ability to maintain balance and proper posture, said therapeutic exercise apparatus comprising:

a hemisphere having two ends, one end of said hemisphere being rounded and the other end being substantially flat; and a cover removably securable to said hemisphere at said substantially flat end, said cover having two sides, one side of said cover being coplanar with said substantially flat end when said cover is secured to said hemisphere such that said coplanar side of said cover forms a portion of said substantially flat end, the other side of said cover having wheels secured thereto such that when said cover is removed from said hemisphere, said cover is capable of being used as a scooter, whereby various balance and postural exercises may be conducted with one of the rounded end and the substantially flat end of the hemisphere contacting the floor or with the cover used as a scooter.

12. The therapeutic exercise apparatus of claim 11, wherein said hemisphere has a hollow internal chamber and said removable cover allows access to said chamber, whereby said internal chamber may be used to store miscellaneous items.

13. The therapeutic exercise apparatus of claim 12, further comprising a leg detachably securable to said cover such that a T-stand is formed by the combination of said cover and said leg, said T-stand allowing for various additional therapeutic exercises to be conducted.

14. The therapeutic exercise apparatus of claim 13, wherein said leg is adjustable so that when secured to said cover the height of said T-stand may be changed to accommodate individuals of varying size.

15. The therapeutic exercise apparatus of claim 14, wherein said leg is dimensioned to be storable within said internal chamber when detached from said cover.

16. The therapeutic exercise apparatus of claim 13, wherein said cover includes a handle for assisting a handicapped individual to balance himself when performing various exercises and for use in carrying said apparatus from one location to another when said cover is secured to said hemisphere.

17. The therapeutic exercise apparatus of claim 16, wherein said cover has two handles, said handles comprising slots formed in said cover extending from one side of said cover to the other, whereby said slots serve as handles for either side of said cover.

18. The therapeutic exercise apparatus of claim 11, wherein said hemisphere is manufactured of a molded foam material and includes a substantially rigid internal shell for support.

19. The therapeutic exercise apparatus of claim 18, wherein said hemisphere includes a disk-shaped portion of increased radius located adjacent to said substantially flat end.

20. The therapeutic exercise apparatus of claim 19, wherein the lip formed by said disk-shaped portion consists of said molded foam material.

21. The therapeutic exercise apparatus of claim 11, wherein either side of said cover is detachably securable to said hemisphere such that the opposite side is coplanar with said substantially flat end, whereby said hemisphere may selectively include wheels at its substantially flat end thereby allowing for various additional therapeutic exercises to be conducted.

22. The therapeutic exercise apparatus of claim 21, wherein said cover is detachably securable to said hemisphere with a hook-type fabric and a loop-type fabric, one type of fabric being secured to both sides of said cover and the other type being secured to said hemisphere such that said hook-type fabric and said loop-type fabric are capable of detachably fastening to each other.

23. Therapeutic exercise equipment capable of being used to initiate controlled postural and equilibrium reactions in a client's body, said therapeutic exercise equipment comprising:

a hemisphere having two ends and a hollow internal chamber, one end of said hemisphere being rounded and the other end being substantially flat;

a cover detachably securable to said hemisphere at said substantially flat end, said cover having two sides, one side of said cover being substantially flat, said substantially flat side of said cover forming a portion of said substantially flat end of said hemisphere when said cover is secured to said hemisphere, said detachable cover providing access to said internal chamber; and a leg detachably securable to said cover such that when said cover is removed from said hemisphere and said leg is attached thereto a T-stand is formed, whereby a number of different therapeutic exercises may be conducted using either of said hemisphere and said T-stand.

24. The therapeutic exercise equipment of claim 23, wherein said cover has at least one handle which facilitates carrying of said hemisphere when said cover is secured thereto and which assists the client in maintaining balance on said T-stand.

25. The therapeutic exercise equipment of claim 23, wherein that side of said cover opposite said substantially flat side includes coasters so that when said cover is removed from said hemisphere said cover is separately usable as a scooter.

26. The therapeutic exercise equipment of claim 25, wherein said cover is detachably securable to said hemisphere such that either side of said cover is coplanar with said substantially flat end of said hemisphere, whereby said substantially flat end may selectively include coasters thereby allowing for various additional therapeutic exercises to be conducted.

27. Therapeutic exercise equipment capable of being used to develop and enhance a handicapped individual's ability to maintain balance and proper posture through the initiation of controlled postural and equilibrium reactions in the individual's body, said therapeutic exercise equipment comprising:

a hemisphere having two ends, one end of said hemisphere being rounded and the other end being substantially flat;

a cover removably securable to said hemisphere at said substantially flat end, said hemisphere having a recessed portion for receiving said cover, said recessed portion having a configuration similar to that of said cover and a depth approximately the same as the width of said cover such that when said cover is positioned within said recessed portion one side of said cover is substantially coplanar with said substantially flat end of said hemisphere; and said cover having two sides, one side of said covering being substantially flat and the other side having wheels secured thereto, said cover being securable to said hemisphere such that either side of said cover is substantially coplanar with said substantially flat end of said hemisphere, whereby said substantially flat end of said hemisphere may selectively include wheels.

28. The therapeutic exercise equipment of claim 27, wherein said cover is dimensioned to be separately usable as a scooter when removed from said hemisphere.

29. The therapeutic exercise equipment of claim 28, wherein said cover includes at least one handle for assisting an individual in maintaining balance while performing various exercises and for use in carrying said hemisphere when said cover is secured thereto.

30. The therapeutic exercise apparatus of claim 28, further comprising an adjustable leg detachably securable to said cover such that a T-stand is formed by the combination of said cover and said leg, the height of said T-stand being adjustable for individuals of varying size.

31. Therapeutic exercise equipment for use in developing and enhancing a handicapped individual's ability to maintain balance and proper posture through the initiation of controlled postural and equilibrium reactions in the individual's body, said therapeutic exercise equipment comprising:

a scooter having a substantially rigid internal plate covered on one side and around its edge by a molded foam exterior, said side having said molded foam exterior being substantially flat, the opposite side having wheels secured thereto; and a leg detachably securable to said scooter at said side having said wheels attached thereto such that a T-stand is formed by the combination of said scooter and said leg whereby various therapeutic exercises may be conducted with either one of said scooter and T-stand.

32. The therapeutic exercise equipment of claim 31, wherein said leg is adjustable such that the height of said T-stand may be varied for individuals of various sizes.

33. The therapeutic exercise equipment of claim 32, wherein said scooter includes at least one handle for assisting an individual in maintaining balance when exercising and for ease of carrying.

* * * * *